US005660110A

United States Patent [19]

Klang

[11] Patent Number: 5,660,110

[45] Date of Patent: Aug. 26, 1997

[54] PLATE MOUNTER FOR FLEXIBLE PRINTING PLATES

[75] Inventor: Bruce J. Klang, Coon Rapids, Minn.

[73] Assignee: Trinity Products, Inc., St. Cloud, Minn.

[21] Appl. No.: 605,538

[22] Filed: Feb. 22, 1996

[51] Int. Cl.[6] ..... B41F 27/12

[52] U.S. Cl. ..... 101/415.1; 101/DIG. 36; 33/618; 33/621

[58] Field of Search ..... 101/382.1, 383, 101/485, DIG. 36, 477; 33/614, 617, 618, 621

[56] References Cited

U.S. PATENT DOCUMENTS

| | | | |
|---|---|---|---|
| 3,390,633 | 7/1968 | Boughton | 101/401.1 |
| 3,616,055 | 10/1971 | Mages | 156/384 |
| 4,446,625 | 5/1984 | Hagan et al. | 33/184.5 |
| 4,449,452 | 5/1984 | Mansell | 101/382 |
| 4,705,590 | 11/1987 | Vandenberg | 33/618 |
| 4,743,324 | 5/1988 | Boyce et al. | 156/215 |
| 4,846,063 | 7/1989 | Brown | 101/415.1 |
| 4,925,506 | 5/1990 | Baker | 156/64 |
| 5,065,677 | 11/1991 | Leader, Jr. | 101/415.1 |
| 5,132,911 | 7/1992 | Leader, Jr. | 364/469 |
| 5,317,971 | 6/1994 | Deye, Jr. et al. | 101/486 |
| 5,331,893 | 7/1994 | Wieland | 101/486 |

FOREIGN PATENT DOCUMENTS

| | | | |
|---|---|---|---|
| 1940878 | 3/1970 | Germany | 101/DIG. 36 |

*Primary Examiner*—Stephen R. Funk
*Assistant Examiner*—Daniel J. Colilla
*Attorney, Agent, or Firm*—Steven P. Skabrat

[57] ABSTRACT

A plate mounter for mounting flexible printing plates on a printing cylinder used in flexographic and letterpress printing processes includes a frame and a table top having a top flat surface located above the frame for supporting the printing plate. The table top is horizontally slidable on lineal bearings towards and away from an operator of the plate mounter. Two opposing vertical support members are joined by a stabilizing bar with an attached handle. The vertical support members are attached to the frame such that they may be moved radially at the bottom end. In between the vertical support members are a plurality of carriage rods holding a horizontal adjustable cylinder carriage. The carriage slides to the left and right along the rods. Attached to the carriage is a tapered spindle facing the right vertical support member. A matching tapered spindle attaches to the right vertical support member. The spindles hold the printing cylinder. The operator loads the printing cylinder on the spindles, places the printing plate on the table top, aligns it, and lowers the printing cylinder in a forwardly downward arc to the printing plate. The operator then pulls on a handle attached to the front edge of the table top, thus sliding the table top forward as the printing cylinder rotates, thereby accurately mounting the printing plate on the printing cylinder.

14 Claims, 3 Drawing Sheets

PLATE MOUNTER FOR FLEXIBLE PRINTING PLATES

BACKGROUND OF THE INVENTION

1. Field of the Invention

This invention relates generally to an apparatus and method for mounting printing plates. More specifically, this invention relates to an apparatus and method for quickly and accurately mounting flexible printing plates used in flexographic and letterpress printing processes onto printing plate cylinders.

2. Background Information

In one form of the printing process, printing is effected by photopolymer or rubber printing plates mounted on printing cylinders. The paper or label to be printed is impressed on the inked printing plate as the cylinder rotates. The cylinder on which the printing plates are mounted is generally called the plate or printing cylinder. The printing plate is typically attached to the printing cylinder with dual-sided tape. The quality of the printing job depends, in a large measure, on the care in which pre-press preparations are carried out. Pre-press preparations include mounting the flexible plate on the printing cylinder, checking color registration, and proofing. Proofing indicates the appearance of the final reproduction, affording a means to check the mounting of the plates for color sequence, spacing requirements, layout, and gear size, as well as copy and color separation. Mounting of the plate is accomplished with the use of commercially available mounting or mounting-proofing machines designed for this purpose.

The mounting of photopolymer or other printing plates onto printing cylinders for subsequent printing requires a high degree of accuracy in the alignment of the plate onto the cylinder. The image on the printing plate must be perfectly square and in register with the printing cylinder in order to print square and in register on the paper or label. When multiple colors are printed or there is the requirement of superimposition of images, the various colors or images are added sequentially via multiple runs through the printing press. Accordingly, it is very important that in each case the printing plate which is adding the successive color or image be synchronized with the preceding plate or plates so that the colors or images are accurately superimposed. If this does not occur, the resulting paper or label may be blurry or fuzzy in certain areas. The arrangement of the printing plates in the exact predetermined relationship with one another requires that their angular as well as their transverse position on the printing plate support apparatus be accurately determined prior to mounting. After the plates are mounted onto the cylinders and short test runs of the printing process are performed, the printing press operator must stop the press to carefully examine the test results. If the results are acceptable, then the operator commences with the printing operation. However, if the results are unacceptable after careful inspection, the operator must remove the plates from the cylinders and start over from the beginning. One can see that this activity is very time-consuming, especially if the printing press operator's skill in aligning the printing plate on the printing cylinder is anything but excellent every time. Substantial down-time in running the printing press results from inaccurate plate mounting, thereby decreasing the efficiency of the overall printing process.

One common method to effect the alignment of the printing plates with respect to the printing cylinder involves the drawing of a line around the printing cylinder. This line is then aligned by eye with a longitudinal line along the length of the photopolymer or other printing plate. The plate is then wrapped around the cylinder. This method is somewhat accurate but can be extremely time consuming for the operator. This leads to delay between print runs.

An early solution to the plate mounting problem is described in U.S. Pat. No. 3,390,633, issued to Boughton. In the Boughton device, the printing plate was laid on a flat surface on top of a rectangular flexible film. The flexible film had rods secured to it at each end. The printing cylinder was then placed on the printing plate, and the operator rolled the printing plate onto the printing cylinder by grasping the rods at either end of the flexible film and curling the ends around the cylinder. This method and apparatus was very error-prone and inaccurate.

Another device used for mounting photopolymer or other printing plates is disclosed in U.S. Pat. No. 3,616,055, issued to Mages. In the optical plate mounter of Mages, the printing cylinder is placed in a fixed relationship to the plate mounting device. The printing cylinder is attached at its ends in front of and slightly below a table top. The printing plate is laid upside down on the clear glass table top. The table top has a grid etched into the glass to assist in alignment of the printing plate. A projector is disposed above the table to shine light down onto the table to assist the operator in aligning the printing plate. However, one disadvantage to the Mages device is that when the operator leans forward to align the plate, his or her head usually casts a shadow over the very area where he or she is attempting to work. This shadow interferes with the operator's vision when aligning the printing plate, thereby negatively affecting the plate alignment process. Once the printing plate is aligned, the operator manually turns the printing cylinder while feeding the printing plate off the table and onto the rotating printing cylinder. One skilled in the art can readily see that this method is very error-prone and results in misalignment of the printing plate on many occasions.

A similar device is disclosed in U.S. Pat. No. 4,449,452, issued to Mansell. The Mansell device also requires the operator to manually rotate the printing cylinder to receive a printing plate held to a flat surface by vacuum suction. Again, the printing cylinder is held in place in front of and below the table top surface. The printing plate is brought to the printing cylinder as the cylinder is turned by hand. Bringing the plate to the cylinder in this manner results in skewed or inaccurate plate mounting an unacceptable percentage of the time. The reason this method is so error-prone is that it is very difficult to retain proper alignment of the printing plate to the printing cylinder as both elements are being moved by the operator.

Another printing plate mounter is shown in U.S. Pat. No. 4,743,324, issued to Boyce et al. This plate mounter uses a table with two separable sections on which to lay the printing plate. The printing cylinder is held below the table top positioned so that as one section of the table top is moved laterally, the printing plate can be slid off the edge of the other table top section and wrapped around the printing cylinder as the cylinder is rotated. This device and its operation are still problematic for the plate mounting process because they still do not solve the deficiencies of the prior art discussed immediately above in that the printing plate is still being brought to the printing cylinder by hand. Hence, misalignment and skewing still result.

Other devices appear in the prior art which utilize more complicated apparatus such as microprocessors and the like, or rely on registration pins and holes to accurately align the printing plates. These devices are too complicated, too costly, or are simply not applicable to the mainstream paper and label printing trade. In addition, many printing shops today have multiple presses designed for specific sizes of printing plates and associated printing cylinders. A plate mounter capable of mounting printing plates on one size of printing cylinder may not work for other sizes of printing cylinders. At times, a printing shop may have to purchase several different plate mounters to ensure it has the capability to mount various sized printing cylinders.

Clearly, what is needed in the flexographic and letterpress printing industry is a simple, relatively inexpensive plate mounter that will allow an operator to quickly and accurately mount a flexible printing plate on a print cylinder. Furthermore, this plate mounter should accommodate a variety of sizes of printing plates and printing cylinders. The plate mounter should allow for both horizontal and vertical alignment, and should be easy to use. The present invention provides a significant advance over the prior art in meeting the needs of the flexographic and letterpress printing industry.

SUMMARY OF THE INVENTION

An object of this invention is to quickly and accurately mount a flexible printing plate on a printing cylinder.

Another object of this invention is to provide a mounting apparatus of simple and efficient design for accurately and quickly mounting flexible printing plates on a printing cylinder preparatory to operation in a flexographic printing press.

Yet another object of this invention is to provide a method for mounting a flexible printing plate on a printing cylinder in an efficient and accurate manner.

A further object of this invention is to minimize the time spent mounting flexible printing plates to printing cylinders for operation in a flexographic printing press.

Another object of this invention is to provide an apparatus capable of quickly and accurately mounting a flexible printing plate on a printing cylinder whereby the flexible printing plate and the printing cylinder may vary among a plurality of sizes.

Additional objects, advantages and novel features of the invention will be set forth in part in the description which follows, and in part will become apparent to those skilled in the art upon examination of the following or may be teamed by practice of the invention. The objects and advantages of the invention may be realized and attained by means of the instrumentalities and combinations particularly pointed out in the Drawings and Description of the Preferred Embodiment, with the scope and aspects of the invention defined in the appended Claims.

According to the present invention, the foregoing and other objects and advantages are attained by a novel plate mounter for mounting flexible printing plates on printing cylinders. The plate mounter include a frame, a table top having a top flat surface located above the frame for supporting the flexible printing plate, the table top being horizontally movable relative to the frame on lineal bearings towards and away from the operator, means for detachably and rotatably holding printing cylinders of various lengths, and means for supporting the printing cylinder holding means above the table top and for moving the rotatable printing cylinder in a forwardly downward arc until the printing cylinder engages the flexible printing plate. A first handle is included on the support means for controlling the forwardly downward arc motion, and a second handle is included for controlling the forward and backward lateral movement of the table top. Lamps are recessed in the base of the frame to project light upward through the table top. Alignment grid lines are included in the table top to aid the operator in aligning the flexible printing plate. An eccentric is included at the junction of one support member and the frame to allow for calibration adjustments to the support structure.

Still other objects and advantages of the present invention will become readily apparent to those skilled in the art from the following detailed description, wherein is shown and described only the preferred embodiment of the invention, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive, and what is intended to be protected by Letters Patent is set forth in the appended Claims.

DESCRIPTION OF THE PREFERRED EMBODIMENT

The present invention is an apparatus and method for mounting flexible printing plates on printing cylinders. As discussed above, one of the primary disadvantages of prior art plate mounters is that they require the printing plate to be brought to the rotating printing cylinder, which allows for skewed or inaccurate plate mounting. A central feature of the present invention is that the printing plate is spread flat upon a table top. The flexible printing plate is held in place by static electricity. A printing cylinder is held in place by the present invention well above the printing plate. The operator aligns the printing plate to a grid or graph etched into a table top. The operator then brings the printing cylinder down into contact with the aligned printing plate. Thus, once the printing plate is aligned true to the grid lines on the table top, the printing plate is not touched again by the operator. This ensures that the alignment set by the operator remains correct during the plate mounting operation.

Figure 1:
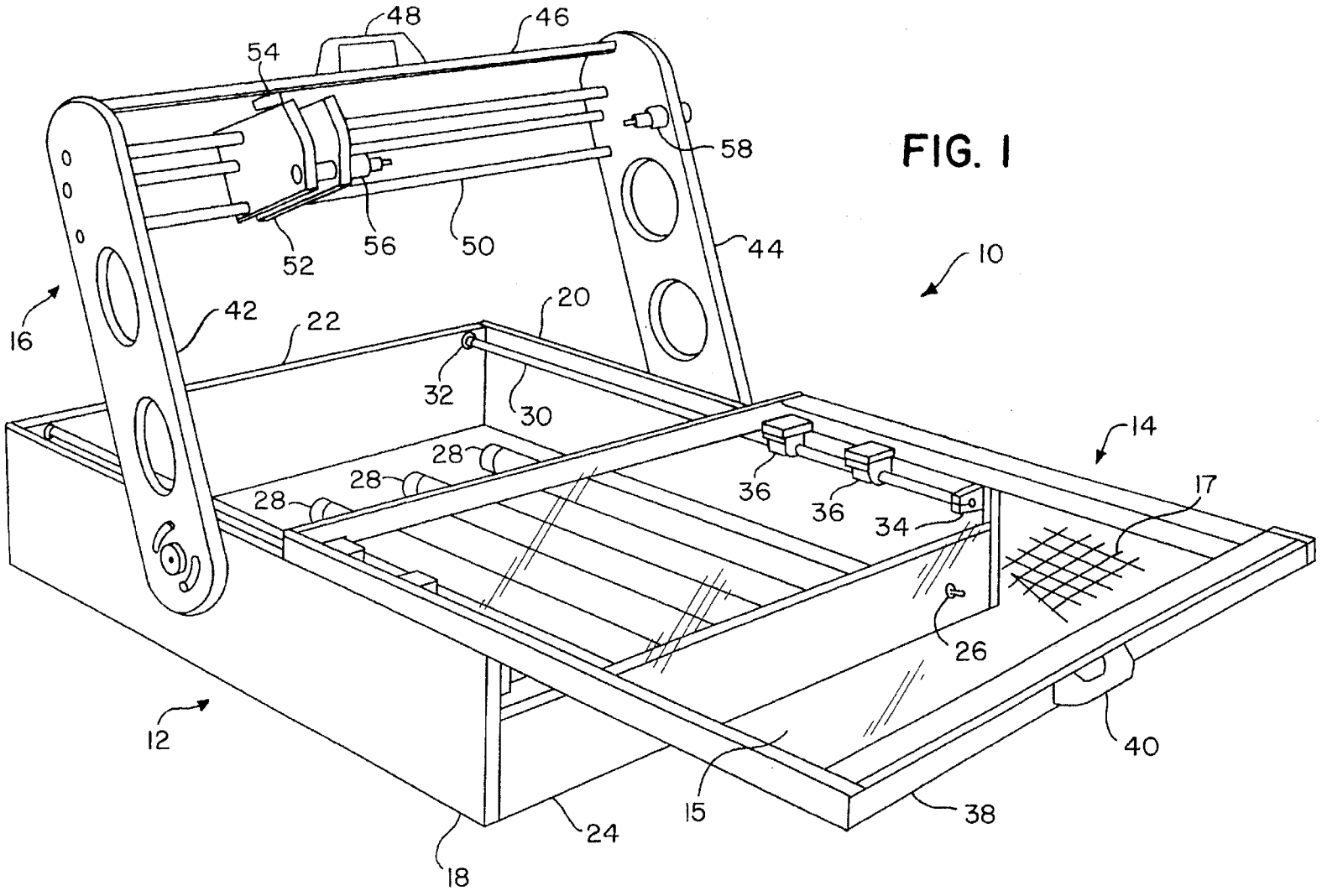
FIG. 1 is a top perspective view of an apparatus for the accurate mounting of a printing plate on a printing cylinder in accordance with the present invention.

The structure and operation of the present invention is best understood by reference to the figures. FIG. 1 is a top perspective view of an apparatus for the accurate mounting of a printing plate on a priming cylinder in accordance with the present invention. As shown in FIG. 1, Plate Mounter 10 is composed generally of a box-like structure called a Main Frame 12, a Table Top 14, and a Tower Assembly 16. In the preferred embodiment, the Main Frame 12, Table Top 14, and Tower Assembly 16 are all made primarily from an aluminum alloy, however, alternate materials or metals could be used for differing requirements related to weight, strength, cost, and the like. The Main Frame 12 has opposing Left 18 and Right Side Frames 20, a Back Side Frame 22, and a From Side Frame 24. The Front Side Frame 24 has a height which is less than the height of the Left Side Frame 18, the Right Side Frame 20, and the Back Side Frame 22. The Side Frames are coupled together in a suitable manner with nuts and bolts, or screws, or other fastening means to form a box. The Main Frame 12 has a Bottom Panel (not discernible in FIG. 1) to enclose the Main Frame 12 from beneath the apparatus. The Main Frame 12 also may have a plurality of Legs (not shown in FIG. 1), mounted at least at the four corners of the Bottom Panel to promote stability of the apparatus.

Within the Main Frame 12 are mounted electrical components to aid the operator in mounting a printing plate onto a plate cylinder. A common electrical Switch 26 controls the "On-Off" operation of a plurality of Fluorescent Lamps 28. A toggle-type switch is shown, but any switch will suffice. The Fluorescent Lamps 28 are permanently mounted to the Bottom Panel, separated by an appropriate horizontal distance so as to project light evenly up through the open top of the Main Frame 12. The wiring for the Fluorescent Lamps is connected to the Switch to control the operation of the Lamps. Electrical power for the Fluorescent Lamps may be obtained via a standard electrical plug into a wall socket or from a battery. A Rod 30 is attached to the Back Side Frame 22 and the Right Side Frame 20 via a Back Mounting Bracket 32 and a Side Mounting Bracket 34. A plurality of Lineal Bearings 36 are radially mounted on the Rod 30 and attached to the Table Top 14. The Table Top may also be thought of as a platform for supporting the printing plate. Identical components are included on the left side of the Plate Mounter 10 to allow the Table Top 14 to move horizontally back and forth (towards and away from the operator, the operator being in front of the Plate Mounter 10) because the Lineal Bearings 36 can slide back and forth over the Rods.

Figure 2:
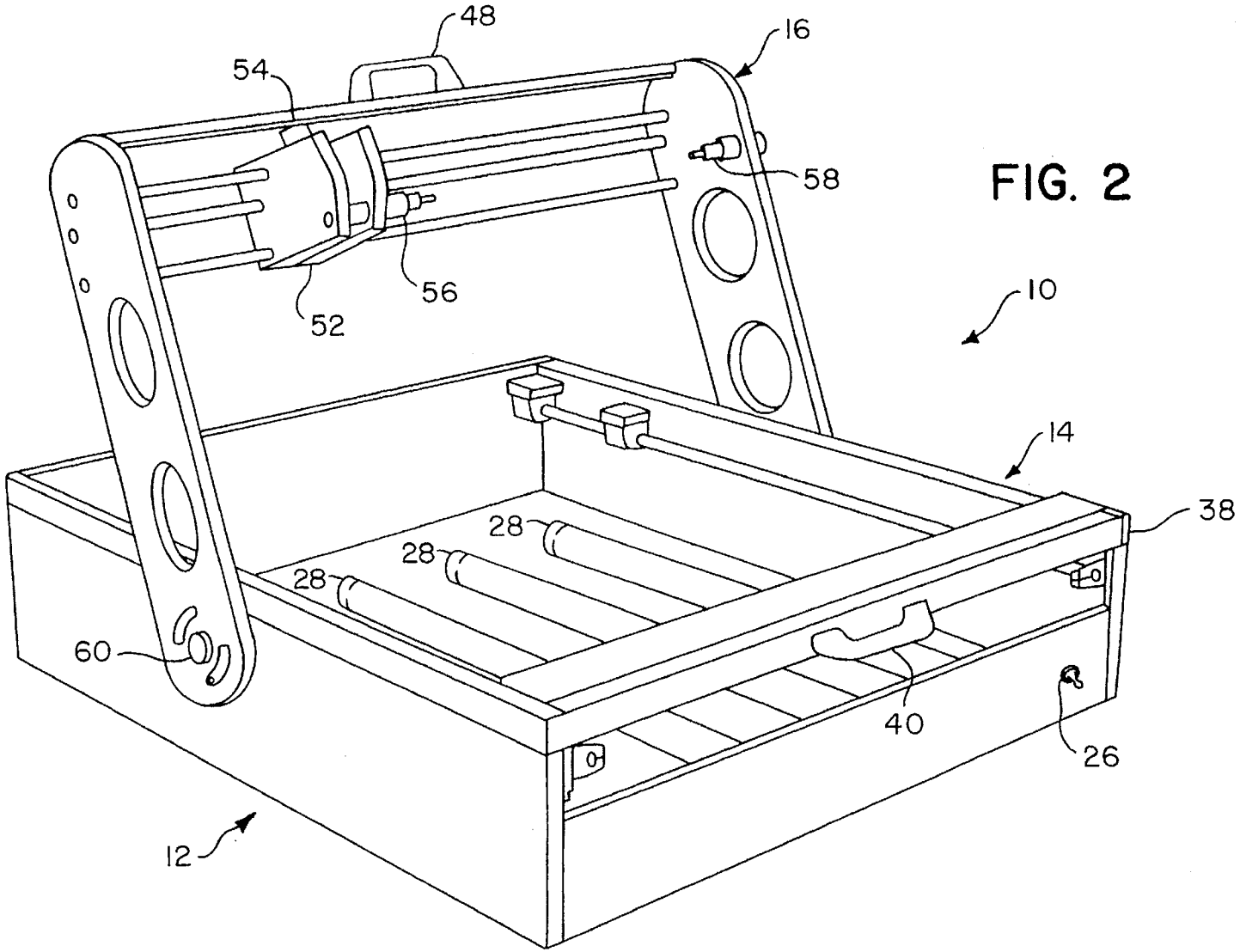
FIG. 2 is a top perspective view of the plate mounter of the present invention with the table top in the starting position.

The Table Top 14 includes a Frame having Left, Right, Front, and Back Table Top Side Frames. Attached to the Front Table Top Side Frame 38 is a Handle 40. During operation of the Plate Mounter, the operator grasps the Handle 40 to pull the Table Top 14 either outward (towards the operator and away from the Main Frame 12) or to push it inward (away from the operator and back into place over the Main Frame 12). FIG. 2 is a top perspective view of the plate mounter of the present invention with the table top in the starting position. FIG. 2 shows the Plate Mounter 10 after the Table Top 14 has been recessed back into the starting position for aligning the printing plate. In the preferred embodiment, the Table Top can traverse at least 36 inches horizontally outward. At least two panes of glass (not shown in FIG. 1) are mounted within the Table Top Side Frames such that a contiguous flat surface is presented on the top of the Table Top. During operation of the Plate Mounter, the printing plate is placed onto the top pane of glass residing in the Table Top 14. The panes of glass enclose a piece of material such as MYLAR (not shown) which has grid lines imprinted on it. The grid lines are used by the operator to align the printing plate. Alternatively, the grid lines may be etched into the top pane of glass. The panes of glass and grid lines function together as an alignment pattern pane 17. When the Fluorescent Lamps 28 are on, the light from the Lamps shines upward through the glass panes of Table Top 14 to present a grid pattern to assist the operator in aligning the printing plate reposed on the Table Top. Note that because the Lamps are under the Table Top, the operator does not obscure his or her vision of the grid and printing plate by a shadow caused by his or her body, as was the case in prior art systems.

Figure 3:
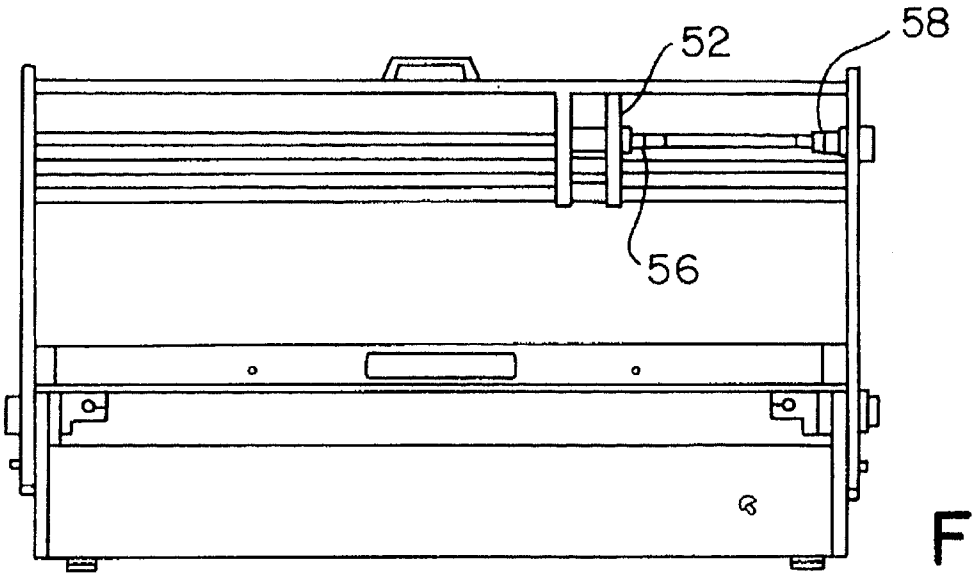
FIG. 3 is a front elevation view of the present invention.
Figure 4:
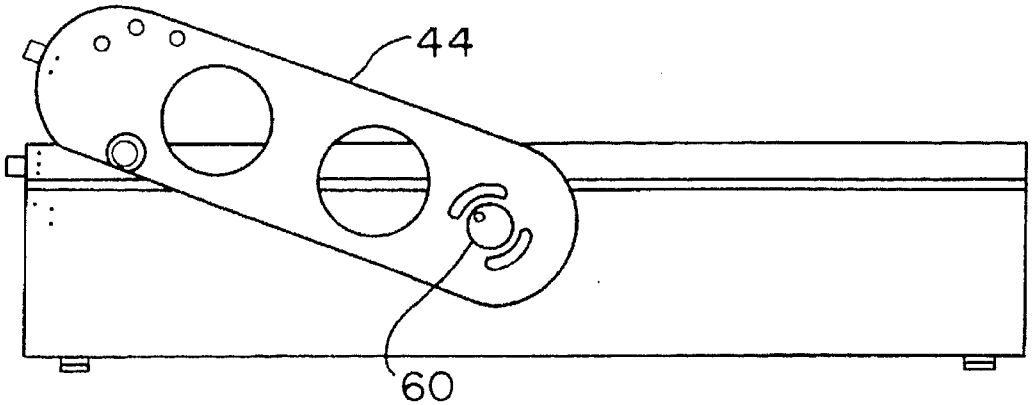
FIG. 4 is an end elevation view of the present invention taken from the right as seen in FIG. 2.

Referring back to FIG. 1, the Tower Assembly 16 has positioning means comprising opposing Left 42 and Right Towers 44 connected by a Stabilizer Bar 46. The Stabilizer Bar 46 ensures that the Towers are rigid. Attached to the Stabilizer Bar 46 is a Tower Handle 48. The operator grasps the Tower Handle 48 to control the movement of the Tower Assembly 16. Carriage Rods 50 also couple the Left and Right Towers as shown in FIG. 1. Means for holding a printing cylinder includes an Adjustable Cylinder Carriage 52 is slidably disposed on the Carriage Rods 50 to allow for movement horizontally left and right along the Carriage Rods. A Locking Knob 54 is used by the operator to anchor the Adjustable Cylinder Carriage into a fixed position as desired. Attached to the Adjustable Cylinder Carriage 52 is a Left Spindle 56 that has a tapered end. Opposite the Left Spindle 56 is a Right Spindle 58 with a tapered end immovably fixed to the Right Tower 44. The Spindles hold the printing cylinder (not shown). Because the Adjustable Cylinder Carriage 52 is capable of moving left to right along the Carriage Rods 50 and locking into place via Locking Knob 54, a variety of sizes of printing cylinders can be utilized with the present invention. If a relatively short printing cylinder is to be used, the Adjustable Cylinder Carriage 52 is slid to the right towards the Right Tower 44 until the printing cylinder (anchored on the Right Spindle 58) is immobilized. The Locking Knob is then tightened to ensure that the printing cylinder is fastened in place. If a longer printing cylinder is to be used, the Adjustable Cylinder Carriage is slid towards the left, thereby accommodating the longer printing cylinder. FIG. 3 is a front elevation view of the present invention. One skilled in the art can clearly see how the Adjustable Cylinder Carriage 52 may be used to engage printing cylinders of different lengths between the Left 56 and Right Spindles 58. FIG. 4 is an end elevation view of the present invention taken from the right as seen in FIG. 2. Right Tower 44 has means for adjusting the positioning means comprising an Eccentric 60 to allow the Right Tower 44 to be positioned left or right, up or down, for calibration purposes. Recall that it extremely important for the Plate Mounter to be square with the printing plate.

Referring back to FIG. 2, operation of the Plate Mounter 10 is simple and may be quickly accomplished by an operator with little training or skill. Initially, the Table Top 14 is in the starting position whereby the Table Top is over the Main Frame 12. The Tower Assembly 16 is in the vertical position. The operator slides the Adjustable Cylinder Carriage 52 to the left to leave an open space in which to insert the desired printing cylinder (not shown). The operator applies the right end of the printing cylinder to the Right Spindle 58 and then slides the Adjustable Cylinder Carriage 52 to the right until the Left Spindle 56 engages the left end of the printing cylinder. The operator then locks the Locking Knob 54, thereby fixing the printing cylinder in place on the Spindles. The Fluorescent Lamps 28 are turned on by activating the Switch 26. The operator places a printing plate on the Table Top 14 and aligns it according to the illuminated grid lines. The operator then grasps the Tower Handle 48 and pulls downward in an arcing movement. This causes the Tower Assembly to rotate on the Eccentric 60 downward towards the Table Top 14. Recall that the printing cylinder typically has a sticky tape applied to it to engage the printing plate. The operator can easily coordinate the downward motion of the Tower Assembly 16 and the horizontal motion of the Table Top 14 (via the Handle 40) to assure that the sticky printing cylinder touches the printing plate lying on the movable Table Top in the desired place. Once a touch has been made, the printing plate adheres to the printing cylinder. The operator then pulls the Handle 40 towards the operator. The printing cylinder rotates on the Spindles, thereby adhering the printing plate to the printing cylinder as the Table Top 14 moves outward. When the printing plate has been successfully wrapped around the printing cylinder, the Locking Knob 54 is loosened, the Adjustable Cylinder Carriage 52 is slid to the left, and the combined printing plate and printing cylinder is removed from the Plate Mounter 10. The Table Top 14 is then slid back to its starting position for future use.

The invention has been described in its presently contemplated best mode, and clearly it is susceptible to various modifications, modes of operation and embodiments, all within the ability and skill of those skilled in the art and without the exercise of further inventive activity. Accordingly, what is intended to be protected by Letters Patent is set forth in the appended Claims.

I claim:

1. A plate mounter for mounting a flexible printing plate onto a printing cylinder by an operator comprising:

a frame;

platform means having a top transparent flat surface and permanently coupled to and located above said frame for supporting the flexible printing plate, said platform means being horizontally slidable relative to said frame towards and away from the operator to cause rotation of the printing cylinder;

printing cylinder holding means for detachably and rotatably holding the printing cylinder in a predetermined position above said platform means, said printing cylinder holding means being horizontally adjustable for holding printing cylinders of different lengths; and positioning means coupled to said printing cylinder holding means and supported on said frame for positioning said printing cylinder holding means above said platform means and for moving said printing cylinder holding means in a downward arc towards the operator until the printing cylinder engages the flexible printing plate.

2. The plate mounter of claim 1, wherein said frame includes a source of illumination, said illumination shining at least upward from said frame through said top transparent flat surface of said platform means.

3. The plate mounter of claim 1, wherein said platform means includes an alignment pattern pane to effect projection of an alignment pattern upwardly onto said top transparent flat surface.

4. The plate mounter of claim 1, wherein said frame includes rigid rods and said platform means includes lineal bearings coupled to said rigid rods, said platform means being horizontally slidable relative to said frame by said lineal bearings sliding on said rigid rods.

5. The plate mounter of claim 4, wherein said platform means includes a platform handle for pulling or pushing said platform means, thereby controlling horizontal slidable movement of said platform means relative to said frame and the printing cylinder.

6. The plate mounter of claim 1, wherein said printing cylinder holding means includes locking means for securing holding of a printing cylinder of a predetermined length.

7. The plate mounter of claim 1, wherein said positioning means includes a positioning handle for pulling said positioning means and said printing cylinder holding means in a downward arc until the printing cylinder engages the printing plate.

8. The plate mounter of claim 1, wherein said positioning means includes means for adjusting said positioning means relative to said frame.

9. A plate mounter for mounting a flexible printing plate onto a printing cylinder by an operator comprising:

a main frame including left and right side frames, a back side frame, a front side frame, and a bottom panel connected together to form a box;

a unitary planar table top having a top transparent flat surface and permanently coupled to and located above said main frame to support the flexible printing plate, said planar table top being horizontally slidable relative to said main frame towards and away from the operator to cause rotation of the printing cylinder;

a stabilizing bar;

opposing left and right supports, rotatably coupled on a first end proximate to said main frame and attached on a second end distal from said main frame to opposing ends of said stabilizing bar;

a right tapered spindle attached to said right support and opposing said left support;

a horizontally adjustable carriage movably coupled to said left and right supports;

a left tapered spindle attached to said horizontally adjustable carriage and opposing said right tapered spindle, said left and right tapered spindles operating to hold the printing cylinder;

a locking knob attached to said horizontally adjustable carriage for securing holding of a printing cylinder of a predetermined size between said left and right tapered spindles;

a first handle secured to said stabilizer bar for pulling said opposing left and right supports, said horizontally adjustable carriage, said left and right tapered spindles holding the printing cylinder, and said locking knob, in a forwardly downward arc towards the operator until the printing cylinder engages the flexible printing plate; and a second handle secured to said planar table top, and extending in advance of said planar table top, to pull or push said planar table top, thereby controlling horizontal slidable movement of said planar table top relative to said main frame and the printing cylinder.

10. The plate mounter of claim 9, wherein said main frame includes a source of illumination coupled to said bottom panel, said illumination shining at least upward from said frame through said top transparent surface.

11. The plate mounter of claim 9, wherein said planar table top includes an alignment pattern pane to effect projection of an alignment pattern upwardly onto said top transparent flat surface.

12. The plate mounter of claim 9, wherein said main frame includes rigid rods attached to said back side frame and said side frames, and said planar table top includes lineal bearings coupled to said rigid rods, said planar table top being horizontally slidable relative to said main frame by said lineal bearings sliding on said rigid rods.

13. The plate mounter of claim 9, wherein said right support includes means for adjusting said right support relative to said main frame.

14. A plate mounter for mounting a flexible printing plate onto a printing cylinder by an operator comprising:

a main frame including left and right side frames, a back side frame, a front side frame, and a bottom panel connected together to form a box, said main frame including rigid rods attached to said back frame and said side frames;

a unitary planar table top having a top flat, transparent surface and permanently coupled to and located above said main frame to support the flexible printing plate, said planar table top including lineal bearings coupled to said rigid rods and being horizontally slidable relative to said main frame towards and away from the operator positioned in front of the front side frame to cause rotation of the printing cylinder;

a source of illumination coupled to said bottom panel, said illumination shining at least upward from said main frame;

an alignment pattern pane integral with said planar table top to effect projection of an alignment pattern upwardly through said top flat, transparent surface;

a stabilizing bar;

opposing left and right vertical supports, each said vertical support rotatably coupled on a first end proximate to said main frame and attached on a second end distal from said main frame to opposing ends of said stabilizing bar;

means for adjusting said left vertical support relative to said main frame;

a right tapered spindle attached to said right vertical support and opposing said left vertical support;

a plurality of carriage rods, each coupled on a first end to said left vertical support and coupled on a second end to said right vertical support;

a horizontally adjustable carriage movably coupled to said plurality of carriage rods;

a left tapered spindle attached to said horizontally adjustable carriage and opposing said right tapered spindle, said left and right tapered spindles operating to hold the printing cylinder;

a locking knob attached to said horizontally adjustable carriage for securing holding of a printing cylinder of a predetermined size between said left and right tapered spindles;

a first handle secured to said stabilizing bar for pulling said opposing left and right vertical supports, said stabilizing bar, said plurality of carriage rods, said horizontally adjustable carriage, said left and right tapered spindles holding the printing cylinder, and said locking knob, in a forwardly downward arc towards the operator until the printing cylinder engages the flexible printing plate; and a second handle secured to said planar table top, and extending in advance of said planar table top, to pull or push said planar table top, thereby controlling horizontal slidable movement of said planar table top relative to said main frame and the printing cylinder.

* * * * *